US005493274A

United States Patent [19]

Long

[11] Patent Number: 5,493,274

[45] Date of Patent: Feb. 20, 1996

[54] GOLF BAG ALARM

[76] Inventor: Richard P. Long, 404 Stryker Ct., Ballwin, Mo. 63021

[21] Appl. No.: 457,127

[22] Filed: Jun. 1, 1995

[51] Int. Cl.[6] ..... G08B 13/14

[52] U.S. Cl. ..... 340/568; 340/566; 340/571; 340/693

[58] Field of Search ..... 340/568, 571, 340/566, 693; 206/315.3

[56] References Cited

U.S. PATENT DOCUMENTS

| | | | |
|---|---|---|---|
| 4,042,918 | 8/1977 | Klitzman | 340/568 |
| 4,538,728 | 9/1985 | Lewis | 206/315.3 |
| 4,716,401 | 12/1987 | Wohlford et al. | 340/568 |
| 4,833,456 | 5/1989 | Heller | 340/571 |
| 5,028,909 | 7/1991 | Miller | 340/568 |
| 5,041,815 | 8/1991 | Newton | 340/568 |
| 5,126,719 | 6/1992 | De Sorbo | 340/571 |

*Primary Examiner*—Glen Swann

[57] ABSTRACT

An alarm for indicating movement of a golf bag to preclude theft. The inventive device includes an elongated support stanchion positionable within the bag. An alarm assembly is coupled to an upper end of the stanchion and shaped so as to resemble a golf club head. The alarm assembly can be remotely armed and operates to sense movement of the bag to sound an alarm and prevent theft of the bag or clubs contained therein.

8 Claims, 4 Drawing Sheets

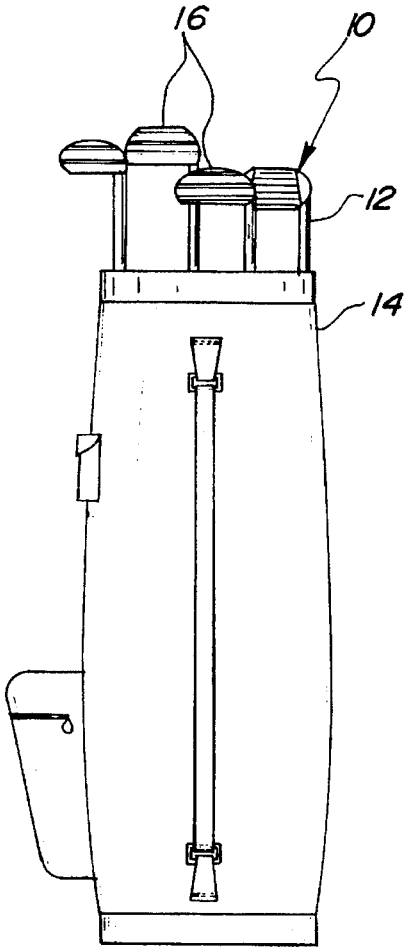
Fig. 1
Fig. 2
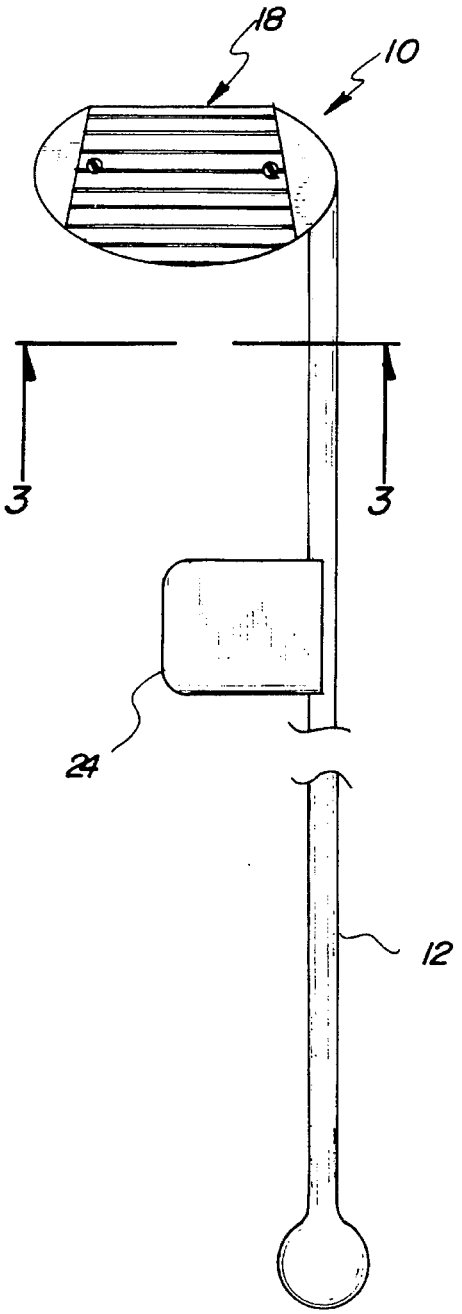

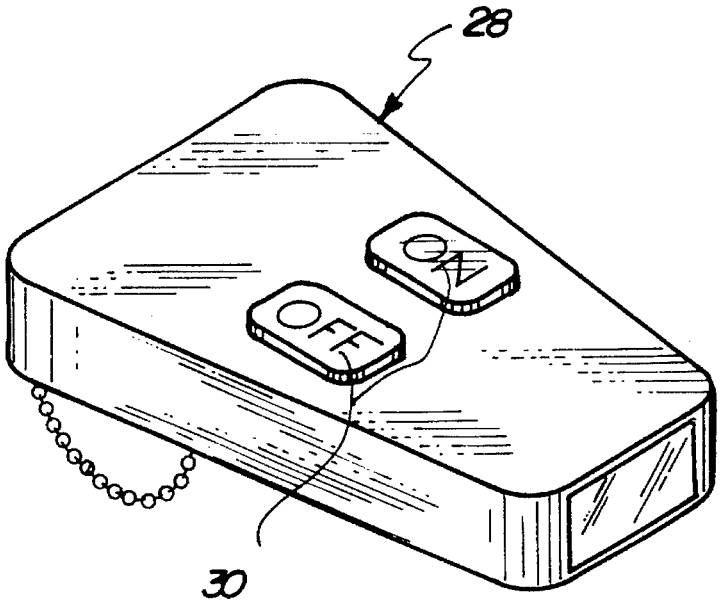
Fig. 5
Fig. 6
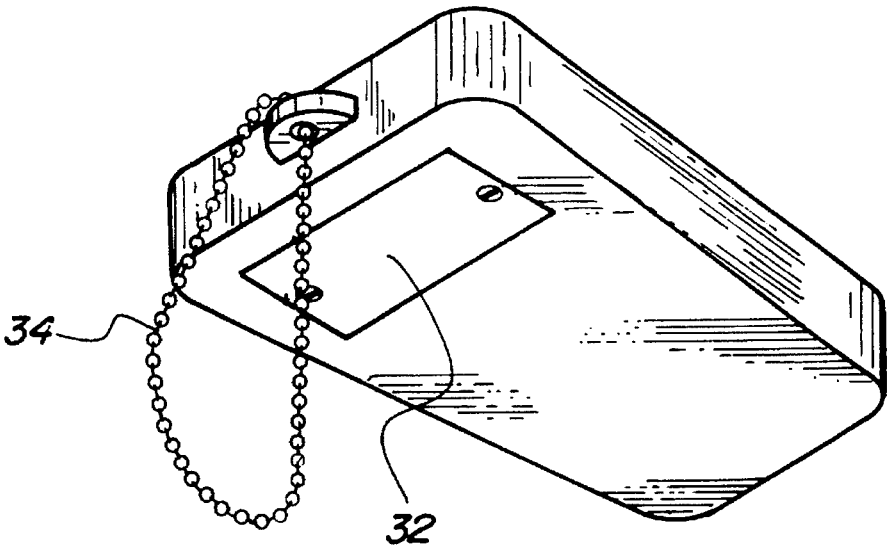

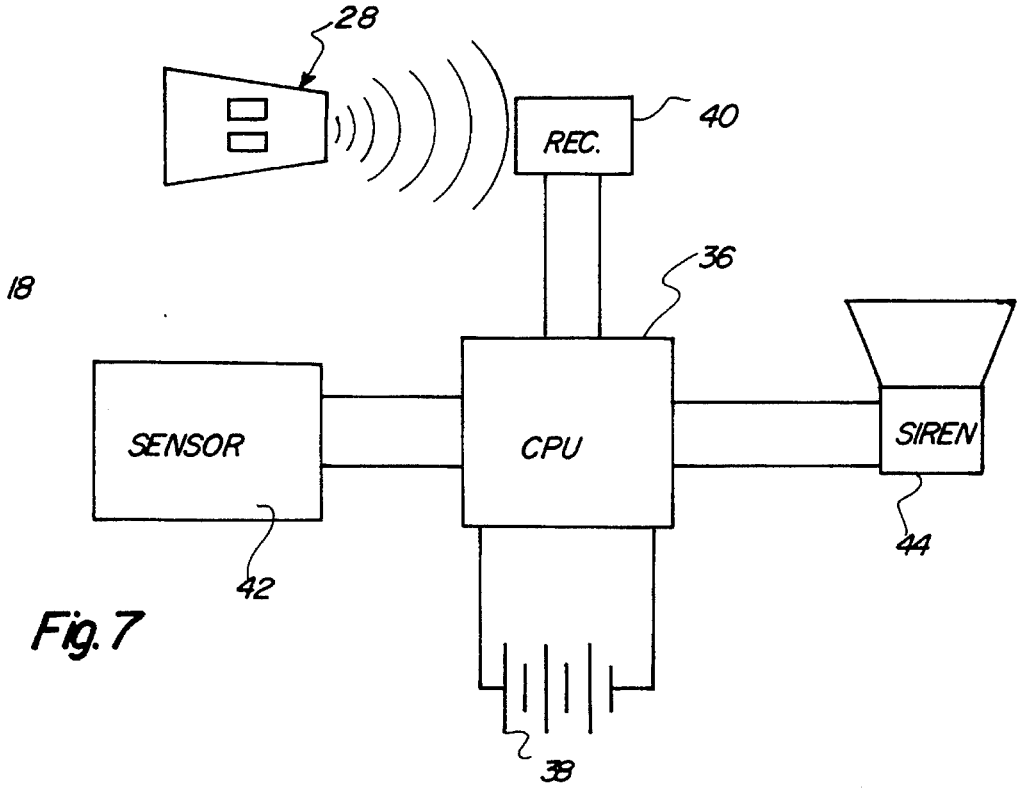
Fig. 7
Fig. 8
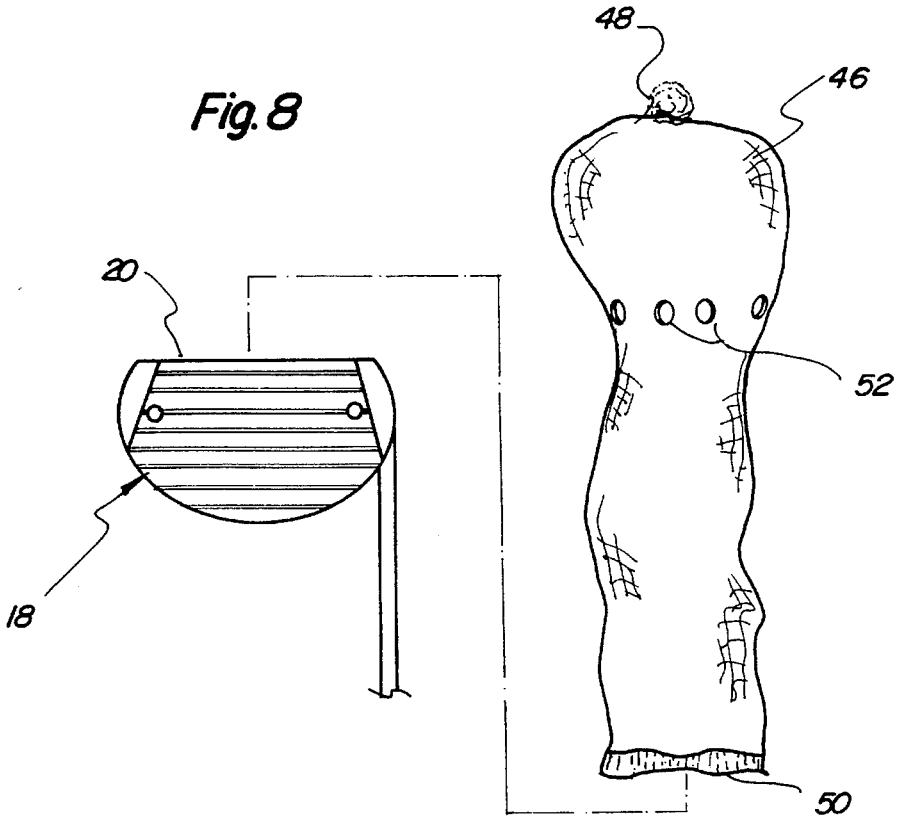

GOLF BAG ALARM

BACKGROUND OF THE INVENTION

1. Field of the Invention

The present invention relates to alarm devices and more particularly pertains to a golf bag alarm for indicating movement of a golf bag to preclude theft.

2. Description of the Prior Art

The use of alarm devices is known in the prior art. More specifically, alarm devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art alarm devices include U.S. Pat. Nos. 5,028,909; 5,041,815; 4,042,918; 4,833,456; 4,716,401; and 4,538,728.

While these devices fulfill their respective, particular objectives and requirements, the aforementioned patents do not disclose a golf bag alarm for indicating movement of a golf bag to preclude theft which includes an elongated support stanchion positionable within the bag, and an alarm assembly coupled to an upper end of the stanchion and shaped so as to resemble a golf club head, wherein the alarm assembly can be remotely armed and operates to sense movement of the bag to sound an alarm and prevent theft of the bag or clubs contained therein.

In these respects, the golf bag alarm according to the present invention substantially departs from the conventional concepts and designs of the prior art, and in so doing provides an apparatus primarily developed for the purpose of indicating movement of a golf bag to preclude theft.

SUMMARY OF THE INVENTION

In view of the foregoing disadvantages inherent in the known types of alarm devices now present in the prior art, the present invention provides a new golf bag alarm construction wherein the same can be utilized for indicating movement of a golf bag to preclude theft of the bag or clubs contained therein. As such, the general purpose of the present invention, which will be described subsequently in greater detail, is to provide a new golf bag alarm apparatus and method which has many of the advantages of the alarm devices mentioned heretofore and many novel features that result in a golf bag alarm which is not anticipated, rendered obvious, suggested, or even implied by any of the prior art alarm devices, either alone or in any combination thereof.

To attain this, the present invention generally comprises an alarm for indicating movement of a golf bag to preclude theft. The inventive device includes an elongated support stanchion positionable within the bag. An alarm assembly is coupled to an upper end of the stanchion and shaped so as to resemble a golf club head. The alarm assembly can be remotely armed and operates to sense movement of the bag to sound an alarm and prevent theft of the bag or clubs contained therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf bag alarm apparatus and method which has many of the advantages of the alarm devices mentioned heretofore and many novel features that result in a golf bag alarm which is not anticipated, rendered obvious, suggested, or even implied by any of the prior art tool guides, either alone or in any combination thereof.

It is another object of the present invention to provide a new golf bag alarm which may be easily and efficiently manufactured and marketed.

It is a further object of the present invention to provide a new golf bag alarm which is of a durable and reliable construction.

An even further object of the present invention is to provide a new golf bag alarm which is susceptible of a low cost of manufacture with regard to both materials and labor, and which accordingly is then susceptible of low prices of sale to the consuming public, thereby making such golf bag alarms economically available to the buying public.

Still yet another object of the present invention is to provide a new golf bag alarm which provides in the apparatuses and methods of the prior an some of the advantages thereof, while simultaneously overcoming some of the disadvantages normally associated therewith.

Still another object of the present invention is to provide a new golf bag alarm for indicating movement of a golf bag to preclude theft.

Yet another object of the present invention is to provide a new golf bag alarm which includes an elongated support stanchion positionable within the bag, and an alarm assembly coupled to an upper end of the stanchion and shaped so as to resemble a golf club head, wherein the alarm assembly can be remotely armed and operates to sense movement of the bag to sound an alarm and prevent theft of the bag or clubs contained therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevation view of a golf bag alarm according to the present invention in use.

FIG. 2 is an elevation view of the invention, per se.

FIG. 5 is top isometric illustration of a remote control for use with the present invention.

FIG. 6 is bottom isometric illustration of the remote control.

FIG. 7 is a diagrammatic illustration of an alarm means comprising a portion of the present invention.

FIG. 8 is an exploded elevation view of the invention including a tubular cover.

DESCRIPTION OF THE PREFERRED EMBODIMENT

Figure 3:
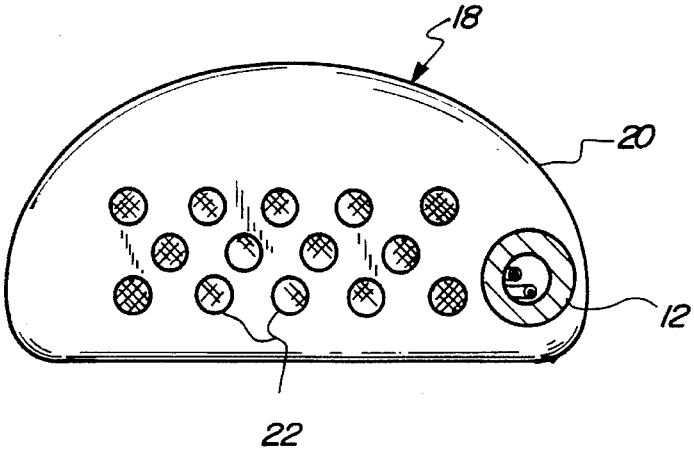
FIG. 3 is a cross sectional view taken along line 3—3 of FIG. 2.
Figure 4:
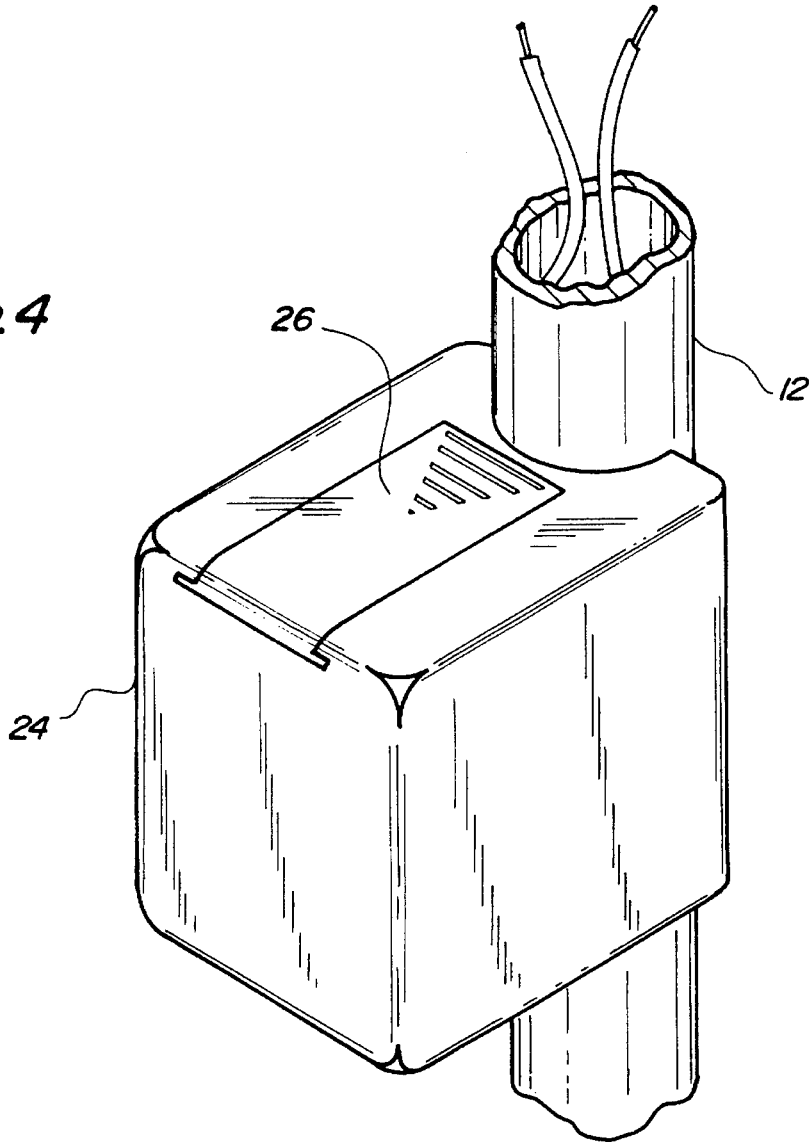
FIG. 4 is an isometric illustration of a portion of the present invention.

With reference now to the drawings, and in particular to FIGS. 1–8 thereof, a golf bag alarm embodying the principles and concepts of the present invention and generally designated by the reference numeral 10 will be described.

More specifically, it will be noted that the golf bag alarm 10 comprises an elongated support stanchion 12 positionable within a golf bag 14 adjacent to a plurality of golf clubs 16 contained therein as shown in FIGS. 1 and 2 of the drawings. An alarm means 18 is mounted to an upper end of the elongated support stanchion 12 for sounding an audible alarm in response to a movement of the golf bag 14 or of the golf clubs 16 contained therein. By this structure, security of the golf bag 14 and associated golf clubs 16 is provided so as to preclude theft of these items.

Referring now to FIGS. 2 through 7 wherein the present invention 10 is illustrated in detail, it can be shown that the alarm means 18 preferably comprises a housing 20 fixedly secured to the upper end of the elongated support stanchion 12. The housing 20 is preferably shaped so as to resemble a golf club head, as shown in the figures, so as to appear to just another one of the golf clubs 16 contained within the golf bag 14 when positioned therein. As shown in FIG. 3, the housing 20 is shaped so as to define a plurality of sound apertures 22 directed therethrough permitting egress of audible noise from an interior of the housing 20 generated by the alarm means 18.

To provided electrical power to the alarm means 18, the present invention 10 further comprises a battery compartment secured to an exterior surface of the elongated support stanchion 12. The battery compartment 24 includes a removal cover 26 permitting the insertion of disposable batteries or the like thereinto which communicates with the alarm means 18 through wires directed through the elongated support stanchion 12.

As shown in FIGS. 5 and 6, the present invention 10 preferably further comprises a remote control 28 of portable construction which can be carried by an individual to effect actuation of the alarm means 18. To this end, the remote control 28 includes a plurality of operating buttons 30 which can be manually operated to cause a transmission of an electrical or optical signal from the remote control for reception by the alarm means 18 in a manner which will subsequently be described in more detail. As shown in FIG. 6, the remote control 28 includes an access cover 32 permitting disposable batteries or the like to be inserted thereinto to provided electrical power for the interior components of the remote control 28. A keychain 34 can be coupled to the remote control for securing the remote control to an associated plurality of keys.

Referring now to FIG. 7 wherein the alarm means 18 is illustrated in a diagrammatic configuration, it can be shown that the alarm means preferably comprises a central computer 36 positioned in electrical communication with a battery 38 which can be stored within the battery compartment 24. A receiver 40 electrically communicates with the computer 46 and operates to receive optical or electromagnetic signals from the remote control 28 to effect arming or disarming of the alarm means 18 in a conventional manner. A motion sensor 42 is electrically coupled to the computer 36 and operates to sense movement of the alarm means 18 such as occurs during movement of the golf bag 14 or one of the golf clubs 16 positioned therein. Upon sensing of motion by the motion sensor 42, the CPU 36 will actuate an audible siren 44 contained within the housing 20 of the alarm means 18 to generate a piercing noise discouraging further movement of the golf bag 14 or associated golf clubs 16. By this structure, the alarm means 18 effectively precludes theft of the golf bag 14 or any one of the golf clubs 16 contained therein.

As shown in FIG. 8, the present invention 10 may further comprise a tubular cover 46 positionable over the housing 20 of the alarm means 18. The tubular cover 46 is shaped so as to define a closed upper end 48 spaced from an open lower end 50, whereby the open lower end can be positioned over the housing 20 such that the housing engages an interior surface of the closed upper end 48 when the tubular cover 46 is fully installed over the alarm means 18. Preferably, the tubular cover 46 is shaped so as to define a plurality of sound apertures 52 directed therethrough permitting egress of audible noise generated by the alarm means 18 through the tubular cover 46.

In use, the golf bag alarm 10 according to the present invention can be easily utilized to detect movement of a golf bag and/or golf clubs 16 positioned therein so as to discourage theft of the associated golfing equipment. The present invention 10, because it is not permanently coupled to the golf bag 14, can be easily utilized with any golf bag 14 and/or collection of golf clubs 16. If desired, the battery 38 utilized for providing electrical power to the alarm means 18 can be incorporated into the housing 20 of the alarm means 18, thereby eliminating the projecting battery compartment 24 from the elongated support stanchion 12. However, it is preferable that the battery compartment 24 accommodate a greater quantity of batteries therewithin so as to ensure long operation of the device 10 during use thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the pans of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag alarm comprising:

an elongated support stanchion positionable within a golf bag adjacent to a plurality of golf clubs contained within the golf bag;

an alarm means mounted to the elongated support stanchion for sounding an audible alarm in response to a movement of the support stanchion.

2. The golf bag alarm of claim 1, wherein the alarm means comprises a housing fixedly secured to an upper end of the elongated support stanchion, the housing being shaped so as to define a plurality of sound apertures directed therethrough permitting egress of audible noise from an interior of the housing generated by the alarm means.

3. The golf bag alarm of claim 2, wherein the housing is shaped so as to resemble a golf club head.

4. The golf bag alarm of claim 3, and further comprising a battery compartment secured to an exterior of the elongated support stanchion, the battery compartment including a removal cover permitting an insertion of batteries into the battery compartment, the battery compartment being electrically coupled to the alarm means so as to supply electrical power from a battery to the alarm means.

5. The golf bag alarm of claim 4, and further comprising a remote control means for remotely operating the alarm means.

6. The golf bag alarm of claim 5, wherein the alarm means comprises a central computer; a receiver electrically communicating with the computer and operates to receive signals from the remote control means to effect arming and disarming of the alarm means; a motion sensor electrically coupled to the computer for sensing movement of the alarm means; an audible siren contained within the housing of the alarm means for generating a noise in response to an actuation of the motion sensor.

7. The golf bag alarm of claim 6, and further comprising a tubular cover positioned over the housing of the alarm means.

8. The golf bag alarm of claim 7, wherein the tubular cover is shaped so as to define a closed upper end spaced from an open lower end, the tubular cover being shaped so as to define a plurality of sound apertures directed therethrough permitting egress of audible noise generated by the alarm means through the tubular cover.

* * * * *